United States Patent [19]

Kaufman et al.

[11] Patent Number: 4,959,912

[45] Date of Patent: Oct. 2, 1990

[54] DOWNHILL SKI BOOT ASSEMBLY

[75] Inventors: William H. Kaufman, Kitchener; Frederick A. Harrison, Kitchener; Claude J. Gidman, Toronto; Gerald Beekenkamp, Paris, all of Canada

[73] Assignee: William H. Kaufman Inc., Kitchener, Canada

[21] Appl. No.: 448,262

[22] Filed: Dec. 11, 1989

[51] Int. Cl.[5] ..... A43B 5/04

[52] U.S. Cl. ..... 36/117

[58] Field of Search ..... 36/117–121

[56] References Cited

U.S. PATENT DOCUMENTS 3,530,595 10/1968 Vogel ..... 36/119

4,748,749 6/1988 Colvard ..... 36/119

FOREIGN PATENT DOCUMENTS 2718939 11/1978 Fed. Rep. of Germany ..... 36/117

*Primary Examiner*—Paul T. Sewell

*Assistant Examiner*—Ted Kavanaugh

*Attorney, Agent, or Firm*—Ridout & Maybee

[57] ABSTRACT

A downhill ski boot assembly utilizes a ski boot shell into which a soft walking boot may be inserted. The shell has a rigid sole plate with a stiff forefoot and shin piece as well as heel hold down means. The forefoot and shin piece has an opening at the toe so that the boot toe may extend therethrough. The heel hold down means of the shell coacts with means on the heel of the boot to hold it in place against the sole plate. A calf strap and an instep strap provide further immobilization of the skier's leg and foot to provide the desired degree of skiing control.

7 Claims, 2 Drawing Sheets

DOWNHILL SKI BOOT ASSEMBLY

The invention is a boot assembly for use with a downhill ski which assembly comprises a soft boot and a stiff boot shell. The soft boot may be secured within the stiff shell which is in turn insertable into the ski binding. The structure of the shell enables the skier to control the attitude of the ski during skiing, while the soft boot allows the skier to walk normally and comfortably when he is not skiing.

It is well recognized that the standard hard shell downhill ski boot is very awkward and uncomfortable to walk in. A number of prior attempts to utilize a reasonably comfortable soft walking boot in combination with support means for use in downhill skiing have suffered from serious shortcomings. Prior devices have predominantly attempted to provide control for the skier through the use of a strut or the like extending from the skier's calf either along the side of the leg or along the back of the leg to the ski binding. These prior devices usually did not provide the skier with a sufficient degree of control over the ski, or they were awkward to use, being cumbersome or complex to attach and adjust. Often the prior devices proved to be of insufficient strength to survive normal downhill skiing maneuvers or mishaps.

The present invention overcomes the disadvantages of prior devices and satisfies a long felt need for a ski boot assembly which may be used with a walking boot. Accordingly, the invention provides a downhill ski boot assembly comprising the combination of a stiff ski boot shell and a flexible walking boot. The ski boot shell has a rigid elongate sole plate with heel and toe portions adapted to be insertable into a conventional downhill ski binding. A unitary stiff forefoot and shin piece is attached to the forward portion of the sole plate. The forefoot and shin piece has an opening at its front to allow the toe portion of a boot to protrude therethrough. Vertically adjustable heel hold down means are attached to the sole plate for engaging the heel portion of a boot and holding it against the sole plate. A calf strap is attached to the top of the forefoot and shin piece.

A flexible walking boot of a size to fit within the ski boot shell has heel means adapted to coact with the heel hold down means of the ski boot shell. In operation the skier wearing the boot inserts it toe first into the ski boot shell so that the toe portion of the boot protrudes through the opening at the toe of the forefoot and shin piece. The boot heel is held against the sole plate by the weight of the skier and the heel hold down means of the ski boot shell is engaged with the rear portion of the boot adapted to so receive said means. The calf strap is secured in place about the skier's leg, and he is then ready to insert the combined ski boot shell and boot into his downhill ski binding.

BRIEF DESCRIPTION OF THE DRAWINGS

Referring to FIG. 1, a preferred embodiment of the invention comprises a ski boot shell 10 having an elongate rigid sole plate 12 being shaped at the heel 13 and toe 14 ends so that it can be inserted into and held by a conventional downhill ski binding. The sole plate may be made of a variety of rigid materials, but a thermoplastic material, possibly reinforced with glass or other suitable material, is preferred.

Attached to the sole plate 12 is a forefoot and shin piece 18 having an opening 19 through which the toe portion of a boot may extend. The piece 18 is preferably unitary and made of a material providing sufficient stiffness for downhill skiing purposes. Preferably, the forefoot and shin piece 18 is made of a thermoplastic material compatible with the material of the sole plate 12. It is desirable for the forefoot and shin piece 18 to possess a degree of flexibility in response to the forward leg pressure of the skier. Portions of the forefoot and shin piece 18 may be reinforced either through the design and shape of the piece itself, e.g. by providing ribs or areas of greater material thickness, or by providing reinforcing members for the piece 18. As an example of the latter, FIG. 1 shows optional reinforcing metal wings 21 extending from the sole plate 12 upwardly along either side of the forefoot and shin piece 18. The wings 21 may be of a metal such as aluminum, and may be molded into the sole plate 12 as well as into the piece 18. Other means of attaching the reinforcing wings 21 to the plate 12 and piece 18 will be apparent to the skilled person. Preferably, the sole plate 12 and the forefoot and shin piece 18, as well as any reinforcing members coacting with these parts, are manufactured and assembled pursuant to an injection molding process.

Figure 1:
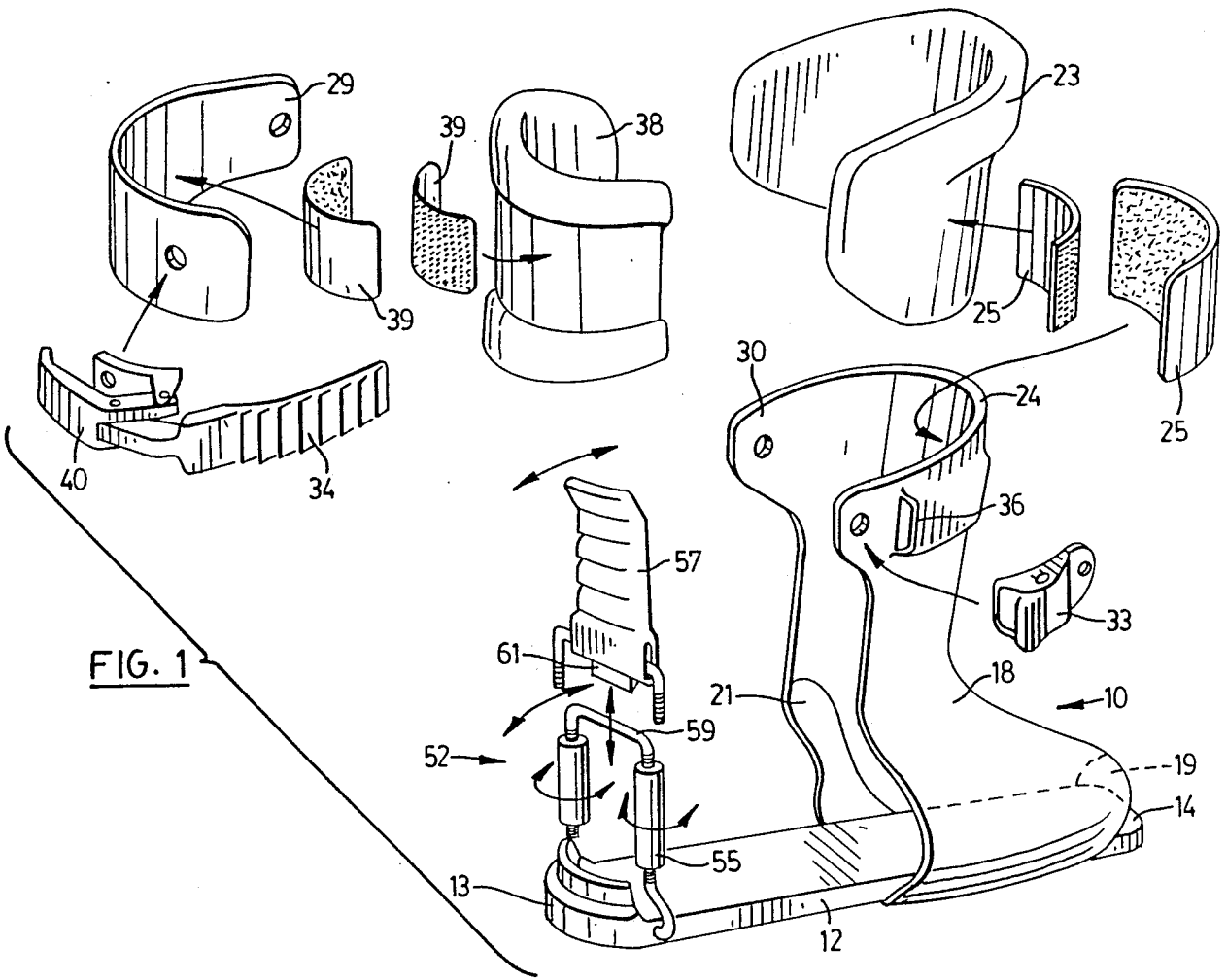
FIG. 1 is an exploded perspective view of a preferred embodiment of the ski boot shell.

The forefoot and shin piece 18 has a shin pad 23 attached to the top inner portion of the piece 18 and which extends over the top front edge 24 of the piece 18. The pad 23 is preferably of a cushioned foam material and may be adjustable by, for example, the use of hook and loop pads 25 available under the trademark VELCRO.

A calf strap 29 is attached to the top rear portion 30 of the forefoot and shin piece 18. The strap 29 is preferably attached at one end to the piece 18 by a fastener such as a rivet, and preferably at the other end to the piece 18 by a buckle means such as a latch 33 and ratchet strap 34. The strap end 34 may conveniently be inserted into a housing 36 formed into the forefoot and shin piece for the purpose. A cushioned calf pad 38 is attached to the calf strap 29 and preferably extends both above and below the lateral edges of the strap 29. As with the shin pad 23, the calf pad 38 may be made adjustable by providing a VELCRO pad 39 attachment to the strap 29.

It is desirable to be able to loosen the calf strap 29 when not actively skiing, so the strap 29 is preferably equipped with an off centre latch 40 which may conveniently be located adjacent the ratchet strap 34.

Figure 2:
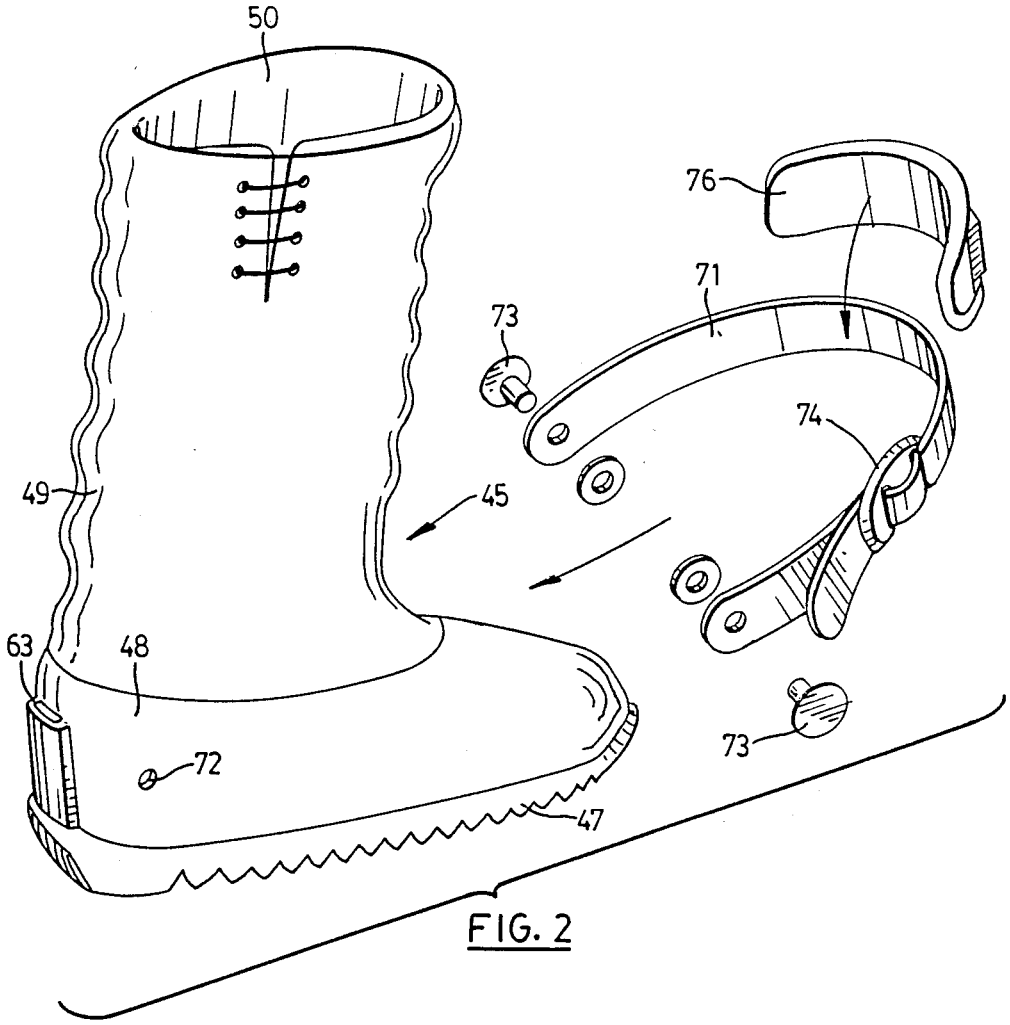
FIG. 2 is an exploded perspective view of a preferred embodiment of the flexible walking boot.

The ski boot shell 10 is intended to be used in association with a comfortable soft boot suitable for walking in when disengaged from the shell 10. A preferred boot 45 is shown in FIG. 2.

The boot 45 is made of a sturdy flexible material conventionally used for a winter walking boot. The preferred boot 45 shown in FIG. 2 has a sole 47 and foot portion 48 made of a rubber, with a lower leg portion 49 being made of a synthetic fabric such as nylon. A felt liner 50 for the boot 45 is preferred to provide insulation and cushioning.

The boot 45 is adapted in the heel portion thereof to coact with heel hold down means 52 of the ski boot shell 10. A preferred heel hold down means 52 is shown in FIG. 1 as an adjustable over centre latch means comprising parallel upright turnbuckles 55 attached to either side of the heel portion of the sole plate 12, and an over centre latch 57 pivotally attached to the turnbuckles 55 through a cross bar 59. The latch 57 has a tongue 61 which is insertable into a slot 63 formed in the heel portion of the boot 45. The slot 63 for receiving the latch tongue 61 may be constructed in a variety of ways, but when the foot portion 48 of the boot 45 is made of rubber, this structure can be conveniently molded integrally with the portion 48. The over centre feature of the latch 57 holds it in place against the rear leg portion of the boot 45 anchoring the heel of the boot against the sole plate 12. The turnbuckles 55 ensure a firm engagement of the latch tongue 61 in the boot heel slot 63.

While the heel hold down means of the ski boot shell 10 and boot 45 operate to hold the sole of the boot 45, and particularly the heel, against the sole plate 12, the skier's foot may still retain an undesirable degree of mobility within the boot 45 itself during skiing. To provide a means for holding the skier's heel down within the boot 45, an instep strap 71 is attached to the boot 45 from pivotal anchor points 72 at either side of the heel, where the strap ends may be secured by rivets 73 or the like. The strap 71 extends forward over the foot in front of the ankle. The strap 71 is preferably in two pieces with a buckle 74 at the outer side of the foot portion 48 for adjustment of the strap 71. An instep pad 76 is preferably attached to the strap 71 to cushion the pressure on the foot provided by the strap 71.

In use, the ski boot assembly of the invention provides the skier with the ability to walk comfortably in the same boots he skis in. With the sole plate 12 in the ski binding, the booted foot is inserted toe first into the forefoot and shin piece 18 so that the toe of the boot 45 extends through the toe opening 19 of the piece 18. The boot heel is pressed down against the sole plate 12 by the skier's weight and the heel hold down latch 57 is engaged in the heel slot 63 of the boot 45 to secure the boot 45 against the sole plate 12. The calf strap 29 is secured about the skier's leg. Just prior to skiing the over centre latch 39 is closed to tighten the calf strap 29 and the instep strap 71 is tightened to immobilize the skier's heel within the boot 45. The assembly according to the invention enables the skier to control his skis as if he were wearing conventional ski boots, but allows him the flexibility and comfort associated with a soft walking boot.

Variations of the preferred embodiment with the scope of the present invention will no doubt occur to the skilled person. Without being limited by the foregoing description, the full ambit of the invention is defined in the following claims.

We claim:

1. A downhill ski boot assembly, comprising:

a ski boot shell having an elongate rigid sole plate with heel and toe portions adapted to be insertable into a downhill ski binding; a unitary stiff forefoot and shin piece attached to the forward portion of the sole plate, the forefoot and shin piece having an opening at the front of it to allow the toe portion of a boot to extend therethrough; adjustable heel hold down means attached to the sole plate for engaging the heel portion of said boot and holding it against the sole plate; and a calf strap attached to the top of the forefoot and shin piece for engaging a skier's lower leg; and said boot being made of a flexible material enabling the wearer to walk normally and being sized to fit in the ski boot shell, the boot having heel means adapted to coact with the heel hold down means of the ski boot shell.

2. A downhill ski boot assembly as claimed in claim 1, further comprising said calf strap attached to the top rear portion of the forefoot and shin piece.

3. A downhill ski boot assembly as claimed in claim 3, wherein the calf strap has buckle means for tightening the strap about the skier's leg.

4. A downhill ski boot assembly as claimed in claim 1, wherein the forefoot and shin piece has a shin pad attached to the inner top portion thereof.

5. A downhill ski boot assembly as claimed in claim 1, wherein the adjustable heel hold down means comprises parallel upward extending turnbuckles attached at their lower ends to the sole plate and by an upper cross member to an over centre latch.

6. A downhill ski boot assembly as claimed in claim 5, wherein the over centre latch has a tongue for engaging a slot defined in the heel portion of the boot, the latch tongue and slot coacting to anchor the boot heel against the sole plate.

7. A downhill ski boot assembly as claimed in claim 1, further comprising an instep strap for the boot, the strap having each end pivotally attached at either side of the heel portion of the boot and the strap being provided with buckle means for adjusting the tension thereof.

* * * * *